US010816213B2

(12) United States Patent
Jones et al.

(10) Patent No.: US 10,816,213 B2
(45) Date of Patent: Oct. 27, 2020

(54) COMBUSTOR ASSEMBLY WITH STRUCTURAL COWL AND DECOUPLED CHAMBER

(71) Applicant: General Electric Company, Schenectady, NY (US)

(72) Inventors: Ryan Christopher Jones, West Chester, OH (US); Scott Matthew Bush, West Chester, OH (US); Paul Christopher Schilling, West Chester, OH (US); Andrew Scott Bilse, West Chester, OH (US)

(73) Assignee: General Electric Company, Schenectady, NY (US)

( * ) Notice: Subject to any disclaimer, the term of this patent is extended or adjusted under 35 U.S.C. 154(b) by 195 days.

(21) Appl. No.: 15/909,107

(22) Filed: Mar. 1, 2018

(65) Prior Publication Data

US 2019/0271471 A1 Sep. 5, 2019

(51) Int. Cl.

| | |
|---|---|
| ***F23R 3/60*** | (2006.01) |
| ***F23R 3/14*** | (2006.01) |
| *F23R 3/00* | (2006.01) |

(52) U.S. Cl.

CPC ..... *F23R 3/60* (2013.01); *F23R 3/14* (2013.01); *F23R 3/002* (2013.01); *F23R 2900/00017* (2013.01)

(58) Field of Classification Search

CPC .... F23R 3/002; F23R 3/60; F23R 3/50; F23R 3/14; F23R 3/04; F23R 3/10; F23R 3/20; F23R 2900/00017; F23R 3/007

See application file for complete search history.

(56) References Cited

U.S. PATENT DOCUMENTS

| | | | | |
|---|---|---|---|---|
| 4,916,905 | A * | 4/1990 | Havercroft | F23R 3/002 60/756 |
| 4,979,361 | A | 12/1990 | Clark et al. | |
| 5,353,587 | A * | 10/1994 | Halila | F23R 3/002 60/39.37 |
| 5,524,430 | A | 6/1996 | Mazeaud et al. | |
| 6,058,710 | A | 5/2000 | Brehm | |
| 6,148,600 | A | 11/2000 | Farmer et al. | |
| 7,861,531 | B2 | 1/2011 | Bunel et al. | |
| 8,156,744 | B2 | 4/2012 | Hernandez et al. | |
| 8,661,829 | B2 | 3/2014 | Bourgois et al. | |
| 8,893,382 | B2 * | 11/2014 | Patterson | F23R 3/002 29/889.2 |
| 9,046,272 | B2 * | 6/2015 | Rice | F23R 3/60 |

(Continued)

*Primary Examiner* — Scott J Walthour
*Assistant Examiner* — Todd N Jordan
(74) *Attorney, Agent, or Firm* — General Electric; Pamela Kachur

(57) ABSTRACT

A combustor includes an outer liner, an inner liner, an annular cowl joining upstream ends of the outer and inner liners, and an annular deflector configured to shield the cowl from hot combustion gases in a combustion chamber defined between the outer liner, the inner liner and the deflector. The cowl has at least one opening for introduction of fuel and compressed air. The deflector includes at least one swirler. The cowl defines at least one axial cowl hole, and the deflector defines at least one corresponding axial deflector hole, wherein the corresponding deflector hole and cowl hole are configured to receive a fastener for fastening together the cowl and the deflector.

18 Claims, 7 Drawing Sheets

(56) References Cited

U.S. PATENT DOCUMENTS

| | | | | |
|---|---|---|---|---|
| 9,506,653 | B2 | 11/2016 | Gerendas et al. | |
| 10,533,437 | B2 * | 1/2020 | Dale | F23R 3/04 |
| 2008/0083841 | A1 * | 4/2008 | Bainville | F02C 7/22 239/419.3 |
| 2016/0290642 | A1 | 10/2016 | Kwoka et al. | |
| 2017/0009988 | A1 | 1/2017 | Cunha et al. | |

* cited by examiner

COMBUSTOR ASSEMBLY WITH STRUCTURAL COWL AND DECOUPLED CHAMBER

FIELD OF THE INVENTION

The present disclosure generally relates to gas turbine engines, and more specifically to combustors of such engines.

BACKGROUND OF THE INVENTION

In a gas turbine engine, pressurized air is provided from a compressor to a combustor, whereupon it is mixed with fuel and is burned in the combustion chamber. As shown in FIG. 1, an annular combustor 1 used in gas turbine engines typically includes outer and inner combustion liners 2, 3 joined at their upstream ends to a dome assembly 4 or simply a "dome". The dome assembly 4 usually includes an annular dome plate 5 and a plurality of circumferentially spaced fuel/air mixers 6 mounted therein for introducing the fuel/air mixture to the combustion chamber. A fuel injector stem (not shown) may extend into each mixer 6 for introducing fuel to the mixer. The amount of pressurized air which enters the mixers and correspondingly the inner and outer passages of the combustor, is typically regulated by outer and inner cowls 7, 8 located upstream of the mixers 6 and the dome plate 5. Each mixer 6 has a deflector 9 extending downstream therefrom for preventing excessive dispersion of the fuel/air mixture and shielding the dome plate 5 from the hot combustion gases of the combustion chamber.

Typically, the dome is the structural member that provides structural rigidity to the combustor, and is used to attach the cowls, deflectors, retainers, supports, and liners. For example, usually the outer cowl 7 and the outer combustor liner 2 are attached to the dome plate 5 by means of a first bolted joint, and the inner cowl 8 and the inner combustor liner 3 are attached to the dome plate 5 by means of a second bolted joint. Accordingly, both the outer and inner cowls 7, 8 experience a slight change in pressure thereacross, as well as a vibratory load induced by the engine. While these environmental factors have a greater effect on the outer cowl, they nevertheless cause wear on both cowls and consequently limit the life thereof.

Therefore, it is desirable to provide a combustor to address at least one of the above-mentioned issues.

SUMMARY OF THE INVENTION

A combustor includes an outer liner, an inner liner, an annular cowl joining upstream ends of the outer and inner liners, and an annular deflector configured to shield the cowl from hot combustion gases in a combustion chamber defined between the outer liner, the inner liner and the deflector. The cowl has at least one opening for introduction of fuel and compressed air. The deflector includes at least one swirler. The cowl defines at least one axial cowl hole, and the deflector defines at least one corresponding axial deflector hole, wherein the corresponding deflector hole and cowl hole are configured to receive a fastener for fastening together the cowl and the deflector.

In some embodiments, the cowl comprises an annular cowl body and the at least one opening is formed in the annular cowl body.

In some embodiments, the cowl comprises at least one mounting rib extending downstream from the annular cowl body, and the at least one axial cowl hole is formed in the at least one mounting rib.

In some embodiments, the at least one opening comprises a plurality of circumferentially spaced openings formed in the annular cowl body, the at least one mounting rib comprises a plurality of mounting ribs extending downstream from positions circumferentially between adjacent openings, and the at least one axial cowl hole comprises a plurality of axial cowl holes formed in the plurality of mounting ribs, respectively.

In some embodiments, the cowl comprises at least one cowl arm extending upstream from the annular cowl body and attached to a casing surrounding the combustor.

In some embodiments, the cowl arm defines a mounting hole corresponding to a mounting hole formed in the casing, for receiving a fastener for attaching the cowl arm to the casing.

In some embodiments, the cowl arm comprises a split frame structure having split first and second legs extending from two circumferentially spaced positions of the cowl and joined at free ends thereof, as a common distal end.

In some embodiments, the cowl comprises an outer mounting flange and an inner mounting flange extending downstream from the annular cowl body, the outer and inner mounting flanges attached to the outer and inner liners, respectively.

In some embodiments, the cowl is a single-piece formed component.

In some embodiments, the deflector is disposed between the outer and inner liners, with an outer circumferential face thereof adjacent the outer liner, and an inner circumferential face thereof adjacent the inner liner.

In some embodiments, the deflector comprises an annular deflector body, and the at least one swirler extends upstream from the annular deflector body.

In some embodiments, the deflector comprises at least one deflector arm extending upstream from the annular deflector body, and the at least one axial deflector hole is defined in the at least one deflector arm.

In some embodiments, the deflector arm comprises a stand portion standing on and substantially perpendicular to the annular deflector body, and a pad portion extending near a distal end of the stand portion and substantially parallel to the annular deflector body, and wherein the axial deflector hole is defined in the pad portion of the deflector arm.

In some embodiments, the at least one swirler comprises a plurality of circumferentially spaced swirlers extending upstream from the annular deflector body, the at least one deflector arm comprises a plurality of circumferentially spaced deflector arm extending upstream from the annular deflector body, at positions circumferentially between adjacent swirlers.

In some embodiments, the deflector is a single-piece formed component.

A method of assembling a combustor having outer and inner liners, includes: joining upstream ends of the outer and inner liners via an annular cowl having at least one opening for introduction of fuel and compressed air; disposing an annular deflector including at least one swirler between the outer and inner liners and adjacent a downstream face of the cowl, to shield the cowl from a combustion chamber defined between the outer liner, the inner liner and the deflector; and fixedly attaching the deflector to the cowl via at least one fastener axially extending into the deflector and the cowl.

In some embodiments, the fastener extends into an axial cowl hole cowl defined in the cowl and an axial deflector hole defined in the deflector.

In some embodiments, the axial cowl hole is formed in a mounting rib extending downstream from an annular body of the cowl, and the axial deflector hole is defined in a deflector arm extending upstream from an annular body of the deflector.

In some embodiments, the annular deflector is disposed between the outer and inner liners with an outer circumferential face thereof adjacent the outer liner, and an inner circumferential face thereof adjacent the inner liner.

The method of claim 16, further comprising attaching at least one cowl arm extending upstream from an annular body of the cowl, to a casing surrounding the combustor.

BRIEF DESCRIPTION OF THE DRAWINGS

The above and other aspects, features, and advantages of the present disclosure will become more apparent in light of the subsequent detailed description when taken in conjunction with the accompanying drawings in which.

DETAILED DESCRIPTION OF THE INVENTION

One or more embodiments of the present disclosure will be described below. Unless defined otherwise, technical and scientific terms used herein have the same meaning as is commonly understood by one of skill in the art to which this invention belongs. The terms "first," "second," and the like, as used herein do not denote any order, quantity, or importance, but rather are used to distinguish one element from another. Also, the terms "a" and "an" do not denote a limitation of quantity, but rather denote the presence of at least one of the referenced items. The term "or" is meant to be inclusive and mean any, some, or all of the listed items. The use of "including," "comprising" or "having" and variations thereof herein are meant to encompass the items listed thereafter and equivalents thereof as well as additional items. The term "coupled" or "connected" or the like includes but is not limited to being connected physically or mechanically, and may be connected directly or indirectly.

Figure 1:
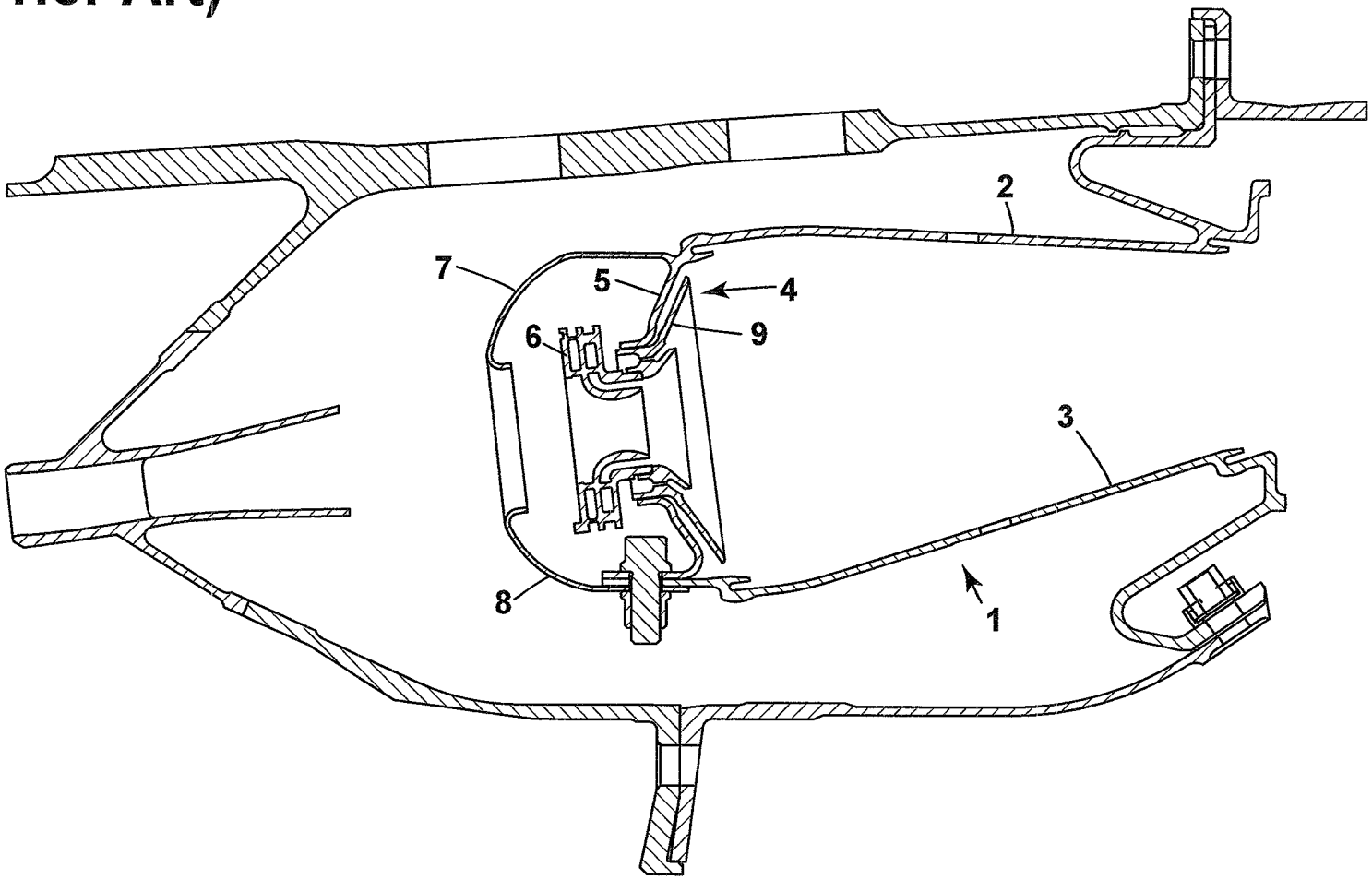
FIG. 1 (Prior Art)
FIG. 1 is a schematic cross-sectional view of a traditional combustor including a combustor dome assembly.
Figure 2:
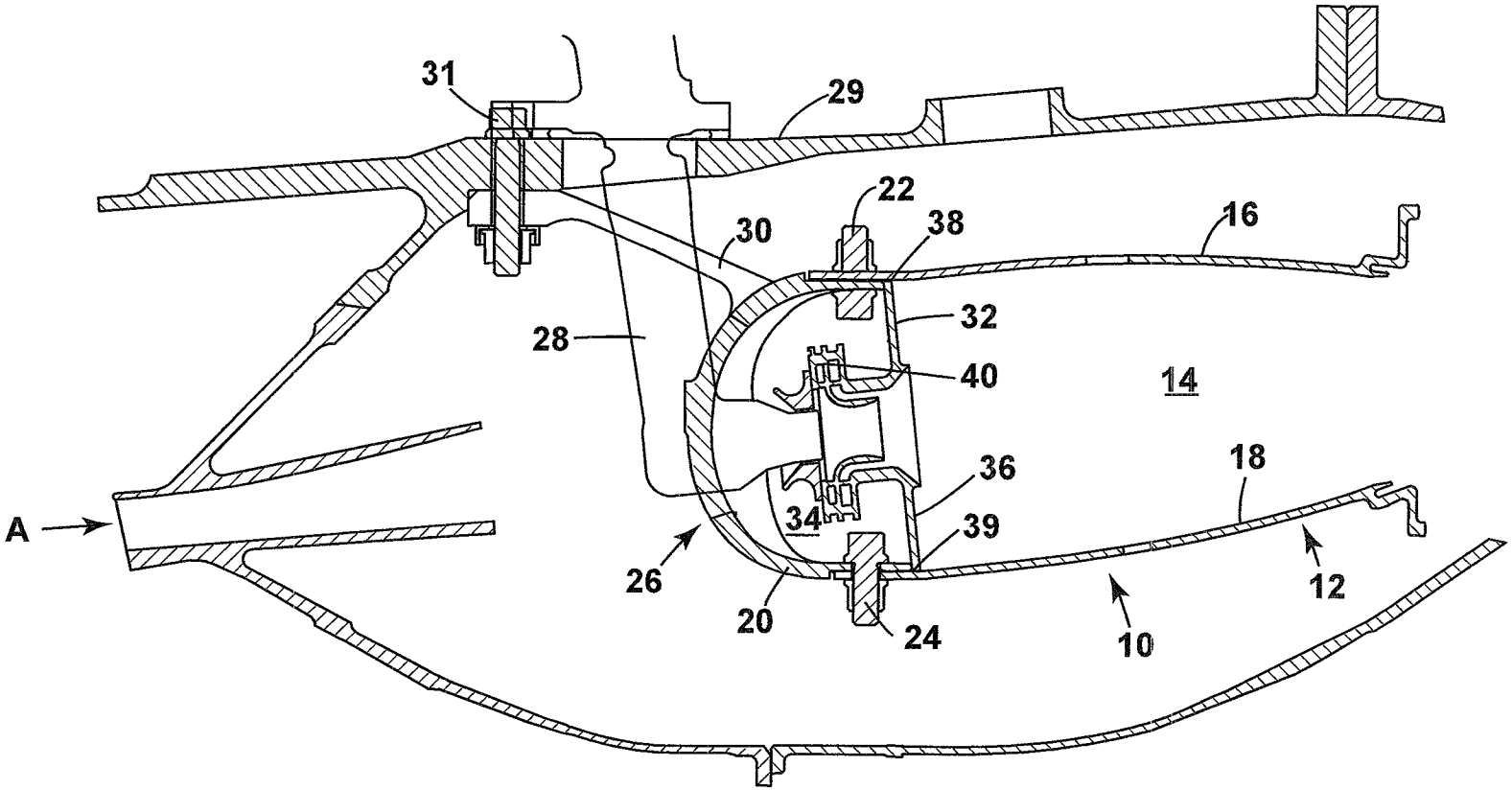
FIG. 2 is a schematic cross-sectional view of a combustor in accordance with an aspect of the present disclosure, in which a fuel injector and a swirler formed on a combustor deflector for coupling the fuel injector, are illustrated.
Figure 3:
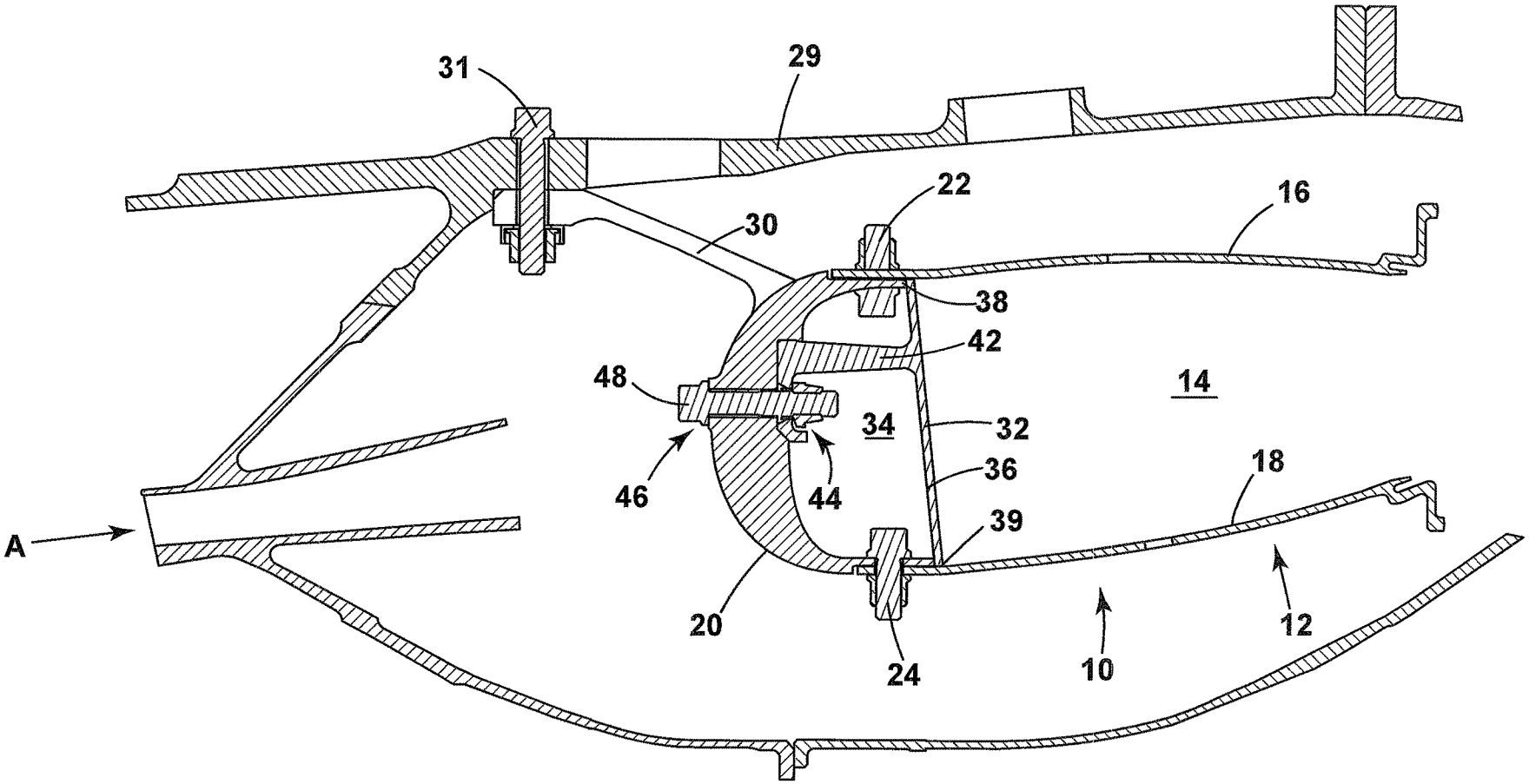
FIG. 3 is another schematic cross-sectional view of the combustor of FIG. 2, in which a retaining arm of the combustor deflector is illustrated.
Figure 4:
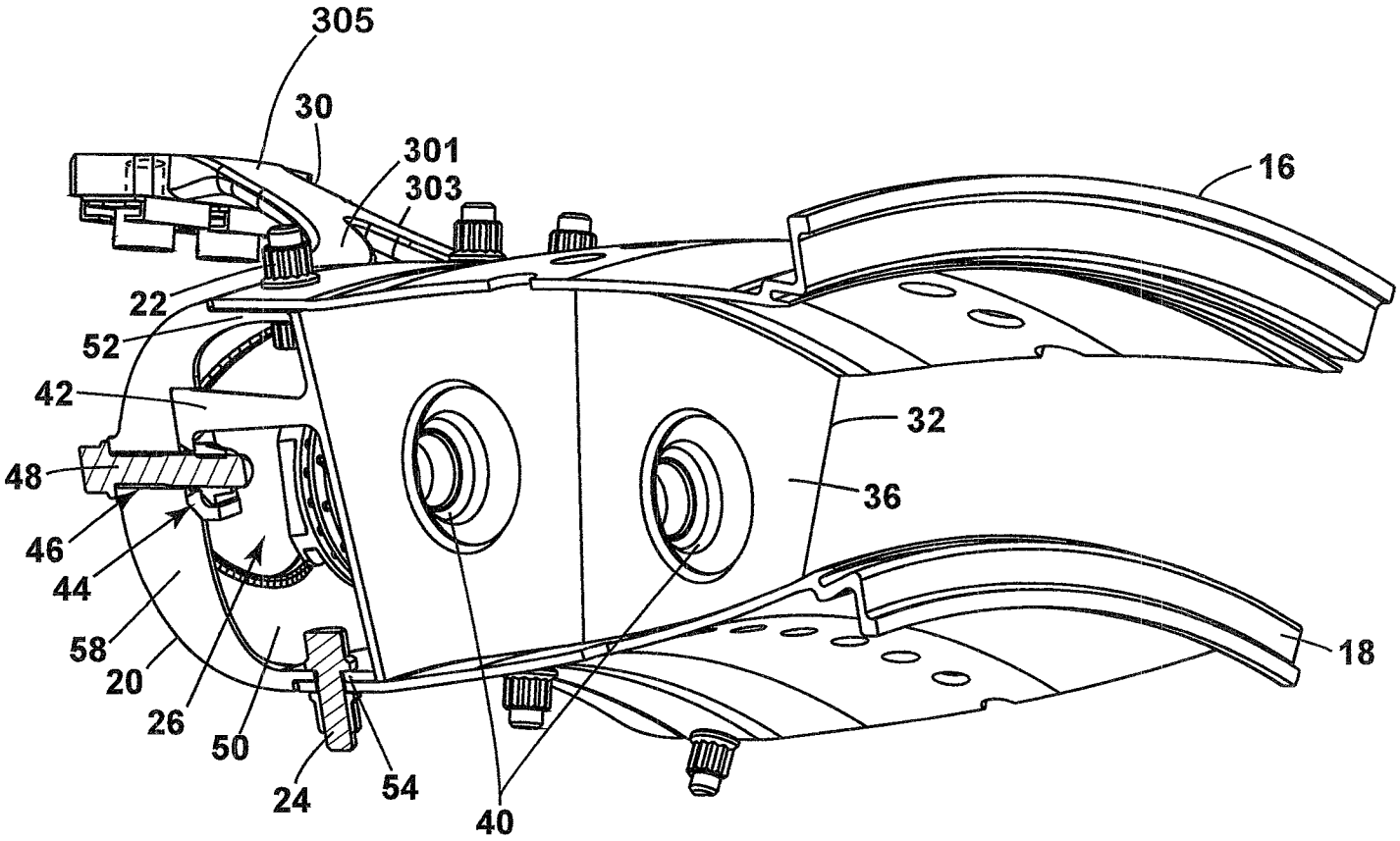
FIG. 4 is a perspective view of a portion of the combustor of FIG. 2, viewed from a first direction.
Figure 5:
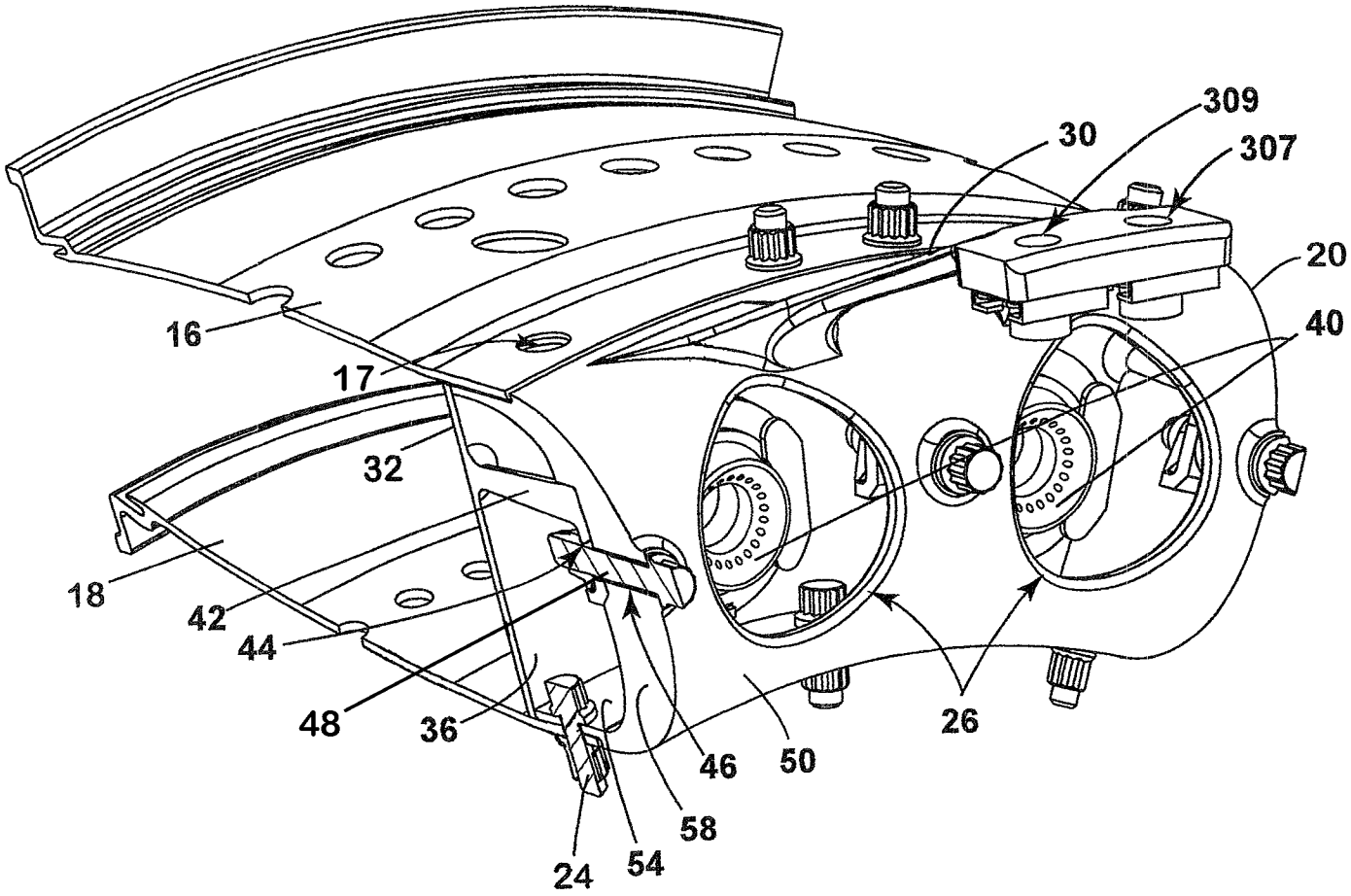
FIG. 5 is another perspective view of the portion of FIG. 4, viewed from a second direction.
Figure 6:
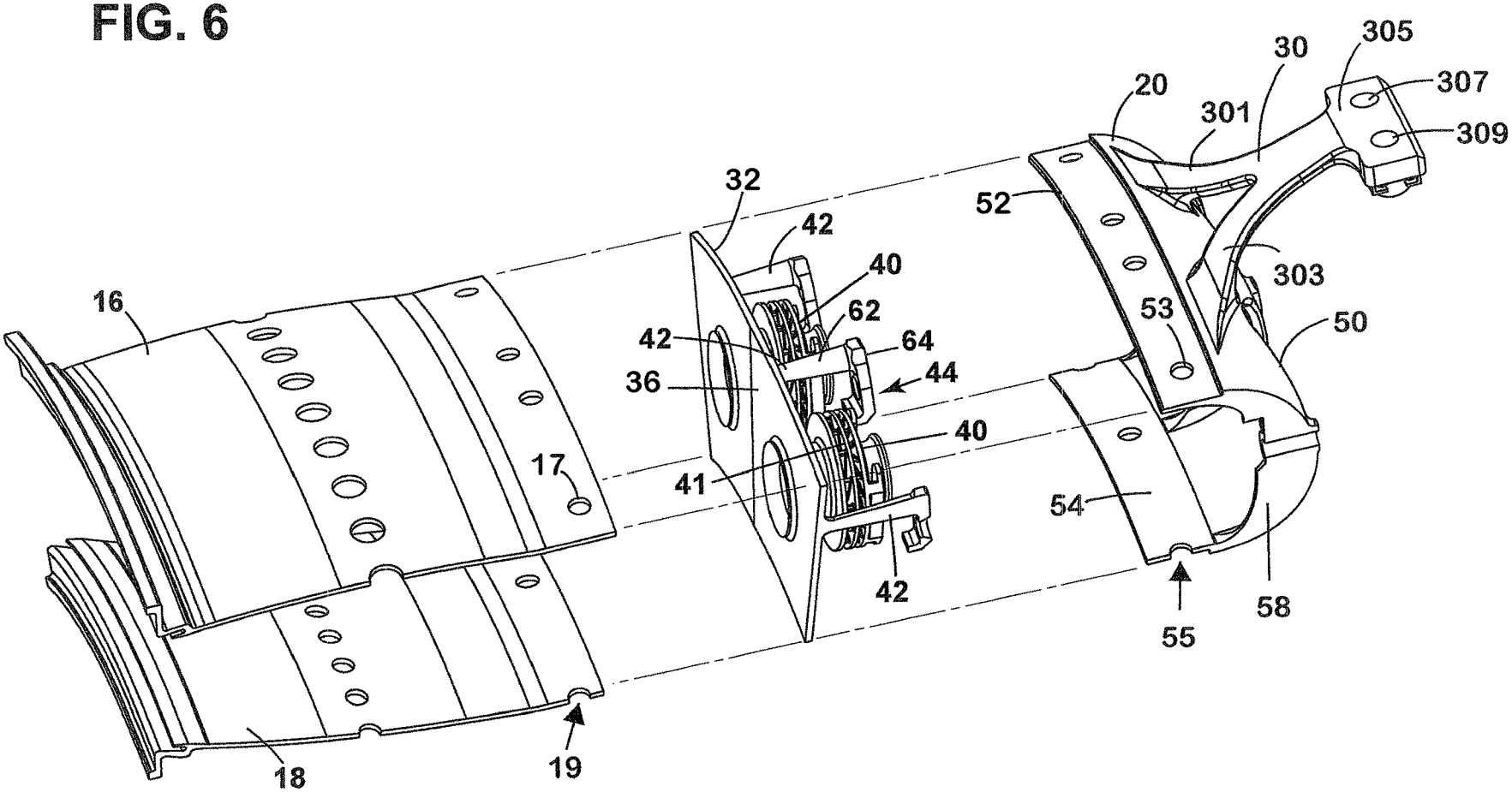
FIG. 6 is an exploded view of the portion of FIG. 5.
Figure 7:
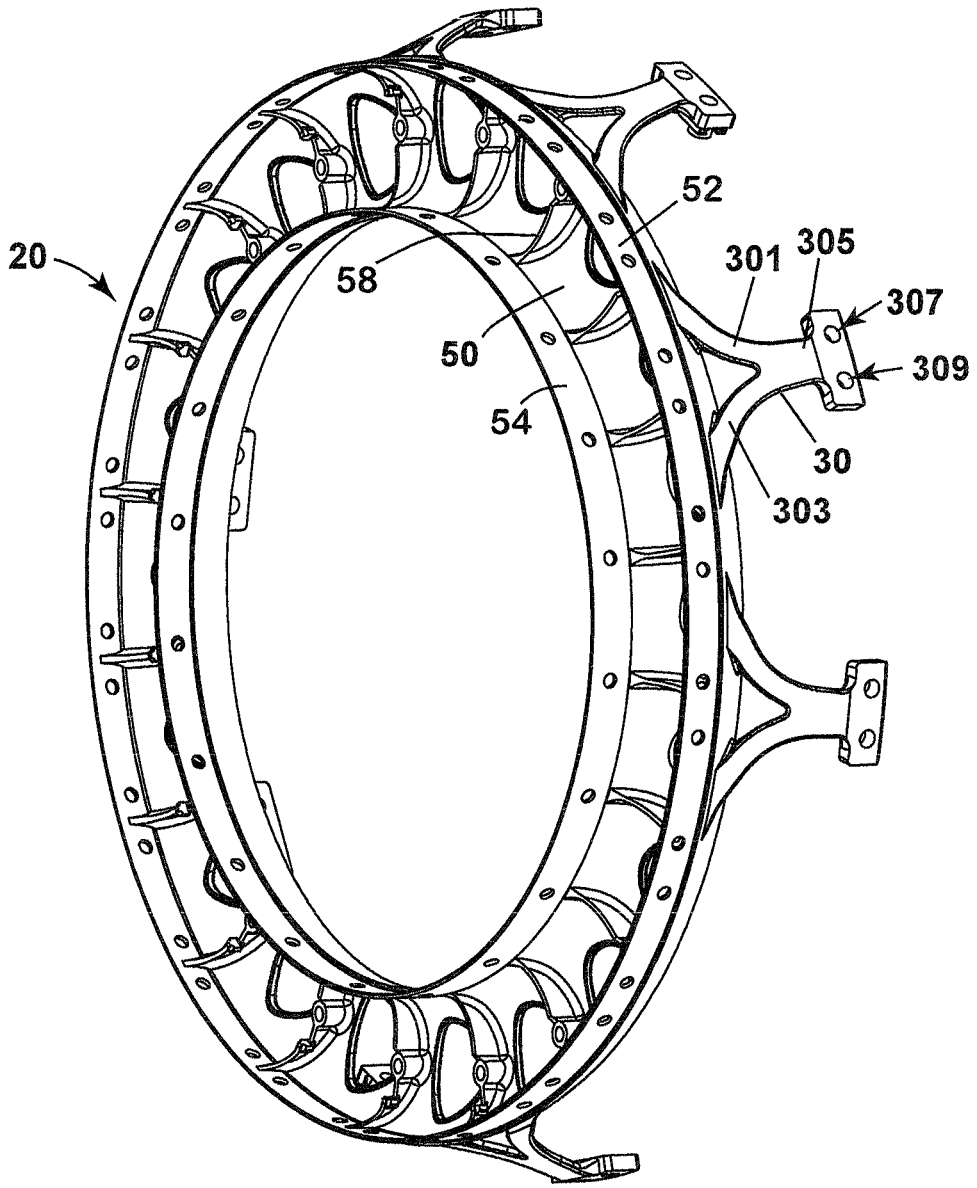
FIG. 7 is a perspective view showing the whole annular cowl of the combustor of FIG. 2.

Referring to the drawings wherein identical reference numerals denote the same elements throughout the various views, FIGS. 2-7 show a combustor 10 of a type suitable for use in a gas turbine engine. FIGS. 2 and 3 are two cross-sectional schematic diagrams of the combustor 10, taken from two different planes. FIGS. 4 and 5 are two perspective views of a portion of the combustor 10 (a circumferential section of an annular cowl-and-deflector assembly of the combustor 10), viewed from two different directions. FIG. 6 is an exploded view of that portion. FIG. 7 is a perspective view showing a whole annular cowl of the combustor 10. FIGS. 4-7 illustrate the structure of the combustor 10 in greater detail.

As shown, the combustor 10 includes a hollow body 12 defining a combustion chamber 14 therein. The hollow body 12 is generally annular in form and is defined by an outer liner 16 and an inner liner 18. The upstream end of the hollow body 12 is substantially closed off by a cowl 20 attached to the outer liner 16 by a first row of fasteners 22 and to the inner liner 18 by a second row of fasteners 24. At least one opening 26 is formed in the cowl 20 for the introduction of fuel and compressed air. The compressed air is introduced into the combustor 10 from a compressor (not shown) in a direction generally indicated by arrow "A". The compressed air passes primarily through the opening 26 to support combustion and partially into the region surrounding the hollow body 12 where it is used to cool both the liners 16 and 18 and turbomachinery further downstream. An array of fuel injector stems 28 (only one is shown in FIG. 2) are mounted in a casing 29 which surrounds the combustor 10. The fuel injector stem 28 extends through the opening 26.

The cowl 20 is configured to regulate flow of the compressed air entering the opening 26 and the region surrounding the hollow body 12, as well as to provide structural rigidity to the combustor assembly, as a structural cowl. In some embodiments, the cowl 20 includes a plurality of retaining arms 30 (also referred to as cowl arms, to distinguish from arms formed on other components) extending from an upstream face thereof. By attaching the retaining arms 30 to the casing 29 via fasteners 31, the cowl 20 is fixed to the casing 29.

An annular deflector 32 is disposed between the outer and inner liners 16, 18 near a downstream face of the cowl 20, with an outer circumferential face 38 thereof adjacent or in contact with the outer liner 16, and an inner circumferential face 39 thereof adjacent or in contact with the inner liner 18. The annular deflector 32 is configured and disposed such that the combustion chamber 14 is defined between the outer liner 16, the inner liner 18 and the deflector 32, and a plenum cavity 34 upstream the combustion chamber 14, is defined between the deflector 32 the cowl 20. In some embodiments, a tight fit is created between the liners 16, 18 and the deflector 32. In some embodiments, the plenum cavity 34 is sealed by the deflector 32 and the cowl 20. The deflector 32 includes an annular deflector body 36, at least one swirler 40 (shown in FIG. 2, also referred to as a mixer) and at least one retaining arm 42 (shown in FIG. 3, also referred to as a deflector arm), both extending upstream, towards the cowl 20, from the deflector body 36. The swirler 40 is configured to receive a distal end of a fuel injector stem 28 therein. The retaining arm 42 is configured to engage with the cowl 20, in order to fix the deflector 32 to the cowl 20. In some embodiments, the retaining arm 42 defines an axial hole 44 (axial deflector hole) extending substantially axially therein, and the cowl 20 defines a corresponding axial hole 46 (axial cowl hole) extending substantially axially therein. The axial holes 44 and 46 are configured to receive a fastener 48 such as a bolt, for fastening together the deflector 32 and the cowl 20. As such, the deflector 32 can be axially attached to the cowl 20, for example, via an axial bolted joint.

More details of the liners 16, 18, the cowl 20, deflector 32, and connections of them will be described hereinafter in conjunction with FIGS. 4-7. As shown in FIGS. 4-7, the annular cowl 20 includes an annular cowl body 50, an outer mounting flange 52 and an inner mounting flange 54 extending downstream from the annular cowl body 50 near an outer and inner circumferential surface of the body 50, respectively. The outer mounting flange 52 defines radial mounting holes 53 corresponding to radial mounting holes 17 formed in the outer liner 16, for receiving the fasteners 22. The inner mounting flange 54 defines radial mounting holes 55 corresponding to radial mounting holes 19 formed in the inner liner 18, for receiving the fasteners 24. There is an array of circumferentially spaced openings 26 (only two are shown) formed in the annular cowl body 50. One opening 26 is provided for a fuel injector stem 28. In some embodiments, the openings 26 are located around the radial middle portion of the annular cowl body 50. An array of circumferentially spaced retaining arms 30 extend upstream from the annular cowl body 50, for example, from positions adjacent the outer mounting flange 52 and circumferentially between adjacent openings 26. Each retaining arm 30 defines at least one radial mounting hole corresponding to at least one radial mounting hole formed in the casing 29 for receiving the fastener 31 (shown in FIGS. 2 and 3).

As best seen in FIGS. 6 and 7, the retaining arm 30 of the cowl 20 FIG. 7 is a split retaining arm provided with a split frame support structure that can effectively absorbs vibrations. In some embodiments, the split frame support structure may have an inverted 'V' shape, and include split first and second legs 301, 303 extending from two circumferentially spaced positions of an annular body 50 of the cowl 20, and joined at free ends thereof, as a common distal end 305. There are two radial mounting holes 307, 309 defined in the distal end 305 of the split retaining arm 30. Such a split frame support structure can increase the capability of absorbing vibrations and reduce rotor imbalance due to undesired motion and imbalance such as rocking, bobbing, swaying, of the fan, the compressor, and/or the turbine blades during operation, and thereby can provide stable supports and increase durability.

The annular cowl 20 further includes mounting ribs 58 extending downstream from the cowl body 50, for example, from positions circumferentially between adjacent openings 26. The mounting rib 58 may radially terminate at the same length as the cowl body 50 and interconnect the outer and inner mounting flanges 52, 54. The axial hole 46 is formed in the mounting rib 58. In some embodiments, the axial hole 46 is a though hole defined through an axial thickness of the mounting rib 58. In some embodiments, each of the mounting ribs 58 is formed with at least one such an axial hole 46.

In some embodiments, the whole cowl 20 is a single-piece formed component, and the cowl parts including the cowl body 50, the outer and inner mounting flanges 52, 54, the retaining arms 30, and the mounting ribs 58 are formed integratedly via additive manufacturing or conventional manufacturing techniques such as casting followed by machining.

The annular deflector body 36 may be an annular plate tightly fitted between the outer liner 16 and the inner liner 18. An array of circumferentially spaced swirlers 40 extend upstream from the annular deflector body 36, at positions corresponding to the array of circumferentially spaced cowl openings 26 for the array of fuel injector stems 28 to pass through, respectively. Each swirler 40 receives a distal end of a fuel injector stem 28 (shown in FIG. 2) therein. As best seen in FIG. 6, the swirler 40 is an annular component with generally cylindrical structure, and it includes a radial array of angularly directed swirl vanes 41. The swirl vanes 41 are angled with respect to the axial centerline of the swirler 40 so as to impart a swirling motion to air flow entering the swirler 40. There is an array of retaining arms 42 extending upstream from the annular deflector body 36, at positions circumferentially between adjacent swirlers 40. In the exemplary embodiment as shown in FIG. 6, the retaining arm 42 includes a stand portion 62 standing on the annular deflector body 36 and a pad portion 64 extending from a distal end of the stand portion 62. The stand portion 62 may extend along an axial direction and substantially be perpendicular to the annular deflector body 36. The pad portion 64 may extend substantially parallel to the annular deflector body 36, for example, along a radial direction. The axial deflector holes 44 are defined in the pad portions 64 of the retaining arms 42. In assembly, as shown in FIG. 4, the fastener such as bolt 48 is inserted into the axial deflector holes 44 and the axial cowl hole 46, and thereby fasten the deflector 32 and the cowl 20.

In some embodiments, the whole deflector 32 is a single-piece formed component, and the deflector parts including the deflector body 36, the swirlers 40, and the retaining arms 42, are formed integratedly via additive manufacturing or conventional manufacturing techniques such as casting followed by machining.

Returning to FIGS. 2 and 3, via the deflector 32, the cowl 20 is shielded from hot combustion gases in the combustion chamber 14. As the deflector 32 is attached axially to the cowl 20, there may be no longer needs for using radial fasteners to attach the deflector 32 to the cowl 20 or the liner 16 or 18. As such, the deflector 32 is prevented from suffering high stress due to the rotation during operation of the engine. Thus, the high stress parts/regions, such as the cowl 20, and the plenum cavity 34 sealed by the deflector 32 and the cowl 20, are segregated from the high temperature parts/regions, such as the deflector 32, and the combustion chamber 14 defined between the deflector 32 and the liners 16, 18.

It should be noted that, although FIGS. 2 and 3 illustrate a single annular combustor, the present disclosure is also applicable to other types of combustors, such as multi-annular combustors. It should be also noted that the present disclosure is applicable to other types of swirlers or retaining arms as well.

In the combustor design as described herein, the use of the structural cowl eliminates the need for a traditional dome that is separately used to provide structural rigidity and attach such as swirler assemblies. The design also decouples the high stress and high temperature regions, and reduces rotor imbalance. Thus, the design may achieve at least some of the following advantages, for example, durability increase, part count reduction, assembly complexity reduction, and cost reduction.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A combustor comprising:

an outer liner extending in an axial direction from an upstream end to a downstream end;

an inner liner extending in the axial direction from an upstream end to a downstream end;

an annular cowl joining the upstream end of the outer liner and the upstream end of the inner liner, the annular cowl having at least one opening for introduction of fuel and compressed air; and an annular deflector downstream of the annular cowl in the axial direction and configured to shield the annular cowl from hot combustion gases in a combustion chamber defined between the outer liner, the inner liner and the annular deflector, the annular deflector comprising at least one swirler, wherein the annular deflector includes an annular deflector body and at least one deflector arm extending upstream from the annular deflector body, wherein the annular deflector body defines a radially outer end and a radially inner end and the at least one deflector arm extends from a portion of the annular deflector body positioned between the radially outer end and the radially inner end, wherein the annular cowl defines at least one axial cowl hole, and the annular deflector defines at least one corresponding axial deflector hole in the at least one deflector arm, wherein the at least one corresponding axial deflector hole is downstream of the at least one axial cowl hole in the axial direction, wherein the at least one corresponding axial deflector hole and the at least one axial cowl hole are coaxial and configured to receive a fastener for fastening together the cowl and the annular deflector.

2. The combustor of claim 1, wherein the annular cowl comprises an annular cowl body and the at least one opening is formed in the annular cowl body.

3. The combustor of claim 2, wherein the annular cowl comprises at least one mounting rib extending downstream from the annular cowl body, and the at least one axial cowl hole is formed in the at least one mounting rib.

4. The combustor of claim 3, wherein the at least one opening comprises a plurality of circumferentially spaced openings formed in the annular cowl body, the at least one mounting rib comprises a plurality of mounting ribs extending downstream from positions circumferentially between adjacent openings of the plurality of circumferentially spaced openings, and the at least one axial cowl hole comprises a plurality of axial cowl holes formed in the plurality of mounting ribs, respectively.

5. The combustor of claim 2, wherein the annular cowl comprises at least one cowl arm extending upstream from the annular cowl body and attached to a casing surrounding the outer liner.

6. The combustor of claim 5, wherein the at least one cowl arm defines a mounting hole corresponding to a mounting hole formed in the casing, for receiving a fastener configured to attach the at least one cowl arm to the casing.

7. The combustor of claim 5, wherein the at least one cowl arm comprises a split frame structure having a first leg and a second leg extending from respective circumferentially spaced positions of the annular cowl and joined at a common distal end.

8. The combustor of claim 2, wherein the annular cowl comprises an outer mounting flange and an inner mounting flange extending downstream from the annular cowl body, the outer mounting flange attached to the outer liner and the inner mounting flange attached to the inner liner.

9. The combustor of claim 1, wherein the annular cowl is a single-piece formed component.

10. The combustor of claim 1, wherein the annular deflector is disposed between the outer liner and the inner liner, with an outer circumferential face of the annular deflector adjacent the outer liner, and an inner circumferential face of the annular deflector adjacent the inner liner.

11. The combustor of claim 1, wherein the at least one swirler extends upstream from the annular deflector body.

12. The combustor of claim 1, wherein the at least one deflector arm comprises a stand portion extending from and substantially perpendicular to the annular deflector body, and a pad portion extending near a distal end of the stand portion and substantially parallel to the annular deflector body, and wherein the at least one axial deflector hole is defined in the pad portion of the at least one deflector arm.

13. The combustor of claim 1, wherein the at least one swirler comprises a plurality of circumferentially spaced swirlers extending upstream from the annular deflector body, the at least one deflector arm comprises a plurality of circumferentially spaced deflector arms extending upstream from the annular deflector body, at positions circumferentially between adjacent swirlers of the plurality of circumferentially spaced swirlers.

14. The combustor of claim 1, wherein the annular deflector is a single-piece formed component.

15. A method of assembling a combustor, wherein the combustor comprises an outer liner extending in an axial direction from an upstream end to a downstream end, an inner liner extending in the axial direction from an upstream end to a downstream end, an annular cowl joining the upstream end of the outer liner and the upstream end of the inner liner, the annular cowl having at least one opening for introduction of fuel and compressed air; and an annular deflector downstream of the annular cowl in the axial direction and configured to shield the annular cowl from hot combustion gases in a combustion chamber defined between the outer liner, the inner liner and the annular deflector, the annular deflector comprising at least one swirler, wherein the annular deflector includes an annular deflector body and at least one deflector arm extending upstream from the annular deflector body, wherein the annular deflector body defines a radially outer end and a radially inner end and the at least one deflector arm extends from a portion of the annular deflector body positioned between the radially outer end and the radially inner end, wherein the annular cowl defines at least one axial cowl hole, and the annular deflector defines at least one corresponding axial deflector hole in the at least one deflector arm, wherein the at least one corresponding axial deflector hole is downstream of the at least one axial cowl hole in the axial direction, wherein the at least one corresponding axial deflector hole and the at least one axial cowl hole are coaxial and configured to receive a fastener for fastening together the cowl and the annular deflector, the method comprising:

joining the upstream end of the outer liner to the upstream end of the inner liner via the annular cowl;

disposing the annular deflector between the outer liner and the inner liner and adjacent a downstream face of the annular cowl; and fixedly attaching the annular deflector to the annular cowl via the fastener, wherein the fastener extends into the at least one axial cowl hole cowl and the at least one corresponding axial deflector hole.

16. The method of claim 15, wherein the axial cowl hole is formed in a mounting rib extending downstream from an annular body of the annular cowl.

17. The method of claim 15, wherein the annular deflector is disposed between the outer liner and the inner with an outer circumferential face of the deflector adjacent the outer liner, and an inner circumferential face of the deflector adjacent the inner liner.

18. The method of claim 15, further comprising attaching at least one cowl arm extending upstream from an annular body of the annular cowl, to a casing surrounding the outer liner.

* * * * *